United States Patent [19]

Wilson

[11] 4,360,949

[45] Nov. 30, 1982

[54] PORTABLE PNEUMATIC RAILROAD SWITCH CLEANING DEVICE

[76] Inventor: Daniel W. Wilson, P.O. Box 481, Rawlins, Wyo. 82301

[21] Appl. No.: 167,846

[22] Filed: Jul. 14, 1980

[51] Int. Cl.[3] ..... A47L 5/14

[52] U.S. Cl. ..... 15/405; 37/202; 104/279; 246/428; 299/31

[58] Field of Search ..... 246/428; 104/279, 280; 299/31; 37/53; 239/565, 287, DIG. 22; 134/131, 144, 151, 198; 15/405

[56] References Cited

U.S. PATENT DOCUMENTS

| | | | |
|---|---|---|---|
| 1,949,904 | 3/1934 | Guedel | 15/405 |
| 2,586,145 | 2/1952 | Breuer et al. | 239/287 |
| 2,604,361 | 7/1952 | Yates | 15/405 |
| 2,655,408 | 10/1953 | Williams | 15/405 |
| 3,117,726 | 1/1964 | Shoberg | 15/405 |
| 3,536,909 | 10/1970 | Czyl | 246/428 |
| 3,697,746 | 10/1972 | Patterson et al. | 246/428 |
| 4,060,874 | 12/1977 | Furutsutsumi | 15/405 |

*Primary Examiner*—Richard A. Bertsch
*Attorney, Agent, or Firm*—Young & Martin

[57] ABSTRACT

A portable pneumatic cleaning device for removing particulate material from crevices and channels particularly between component parts of railroad switch mechanisms, is provided which has a heavy duty nozzle including a central port and a pair of outwardly divergent side ports having axes which are coplanar with the axis of the central port for discharging a pressurized stream of air in a generally fan-shaped pattern along a surface to be cleaned when the device is connected to a pressurized air source. The device has an elongated body portion and end portions formed at an angle therewith and parallel to one another, and includes a switch for controlling the flow of air therethrough, a runner to maintain the nozzle at a spaced distance from a surface to be cleaned, and a handle to facilitate manual use of the device.

14 Claims, 5 Drawing Figures

PORTABLE PNEUMATIC RAILROAD SWITCH CLEANING DEVICE

BACKGROUND OF THE INVENTION

This invention relates to a portable pneumatic air jet cleaning device which operates to clean crevices and the like by directing streams of pressurized air along a surface to be cleaned so as to remove loose debris, snow, and the like. The present invention is particularly adapted for pneumatic removal of snow between closely spaced-apart railroad rails and especially for cleaning between portions of a railroad switch which are susceptible to becoming jammed as a result of snow packed between the switch rails.

The need for a device which can clean crevices and the like has long been recognized, and several devices have been constructed to remove debris from various hard-to-reach crevices. For example, U.S. Pat. No. 2,320,964, issued June 1, 1943, to Yates, discloses a safety air nozzle which expels a highly pressurized stream of air from an elongated nozzle and a second, conical skirt of air surrounding the elongated nozzle.

Another attempt at providing an air nozzle for cleaning debris from inaccessible locations is shown in U.S. Pat. No. 3,117,726 issued Jan. 14, 1964, to Schoberg. The Schoberg patent discloses a nozzle which also directs a concentrated stream of air through a main port with this main stream being surrounded by a conical skirt of pressurized air from a concentric outlet to prevent debris from blowing back onto the operator. This skirt of air is outwardly directed by means of the sidewalls of the central nozzle portion of the apparatus.

However, the applicant has tried these prior art and other experimental devices, and none of the prior art known to the applicant discloses a system adequate for efficient removal of snow between the rails of a railroad switching track. In constructions having a skirt of air similar to the teachings of the patents to Yates and Schoberg, the conical skirt causes the snow to be blown back into the crevice already cleaned so that the rails still are mechanically blocked or jammed by snow and are thus prevented from adequately switching from one mode to another. Further, the force generated by these systems of air pressure jets has not proven sufficient to blow away large masses of snow which accumulate on the rails of a railroad switch yard in climates where heavy and blowing snow is common. There is therefore the need for a portable air jet cleaning device which has sufficient power to actually lift large quantities of chunks of snow, debris, or the like, and to propel it away from a crevice in a manner which prevents the material from refilling the crevice as the device is moved therealong.

SUMMARY OF THE INVENTION

It is an object of the present invention to provide a portable jet cleaning device which is connectable to a pressurized air source for removing particulate matter from crevices and channels.

It is another object of the present invention to provide an elongated pneumatic cleaning device which discharges a pressurized, fan-shaped pattern of air from a pressurized air source along a surface to be cleaned.

It is yet another object of the present invention to provide a pneumatic cleaning device which controllably discharges a high powered blast of pressurized air in a forwardly directed manner along a surface to be cleaned in a pattern which lifts particulate material upwardly from that surface.

A still further object of the present invention is to provide a portable air cleaning apparatus having a heavy-duty, damage-resistant nozzle maintained in a spaced-apart relation from a surface to be cleaned and which discharges a central high-powered stream of air in a forwardly directed manner and outwardly divergent, planar streams of air on either side of the main stream.

It is still a further object of the present invention to provide a pneumatic cleaning device adapted for removing snow from the channel between closely spaced-apart railroad rails in switch mechanisms such that the snow is lifted upwardly from between the rails and pushed to either side thereof without allowing the snow to re-enter the channel behind the device.

To accomplish these objects, a portable pneumatic railroad switch cleaning device for cleaning crevices, channels, and the like is provided which is connectable to a pressurized air source. The cleaning device has an elongated hollow body member which has one end connectable to an air source and a nozzle at the opposite end so that air may be discharged from the nozzle. The nozzle includes jet means which discharges the stream of pressurized air in a fan-shaped pattern from the end of the nozzle along the surface to be cleaned.

In the preferred embodiment of the present invention, the nozzle includes a main jet port which discharges a conical stream of air, and a pair of side ports which discharge divergent streams of air on either side of the main conical stream with these divergent streams being oriented on the same axis as the main jet port in a common plane therewith. These side jets are outwardly divergent from one another at an angle of less than 45°, and are preferably oriented symmetrically about the axis of the main jet port.

In order to protect the nozzle ports from damage, a groove is formed concentrically of the central port and the side ports have exterior mouths which intersect this groove formed in the face of the nozzle, and a runner is provided underneath the nozzle to maintain the nozzle in spaced-apart relation from the surface to be cleaned. The main body of the apparatus is formed as an elongated hollow tube having end portions which are formed parallel with one another and at an angle with respect to the main body of the tube. This allows an operator to use the apparatus while standing in an upright position, and handle is provided to allow convenient grasping by the hand of the operator. Finally, an actuating valve is provided at the end of the main body tube opposite the nozzle end so that the operator man control the air flow of air through the apparatus.

These and other objects of the invention will become more readily appreciated and understood from a consideration of the following detailed description of the preferred embodiment when taken together with the accompanying drawings, in which:

DETAILED DESCRIPTION OF THE PREFERRED EMBODIMENT

Figure 1:
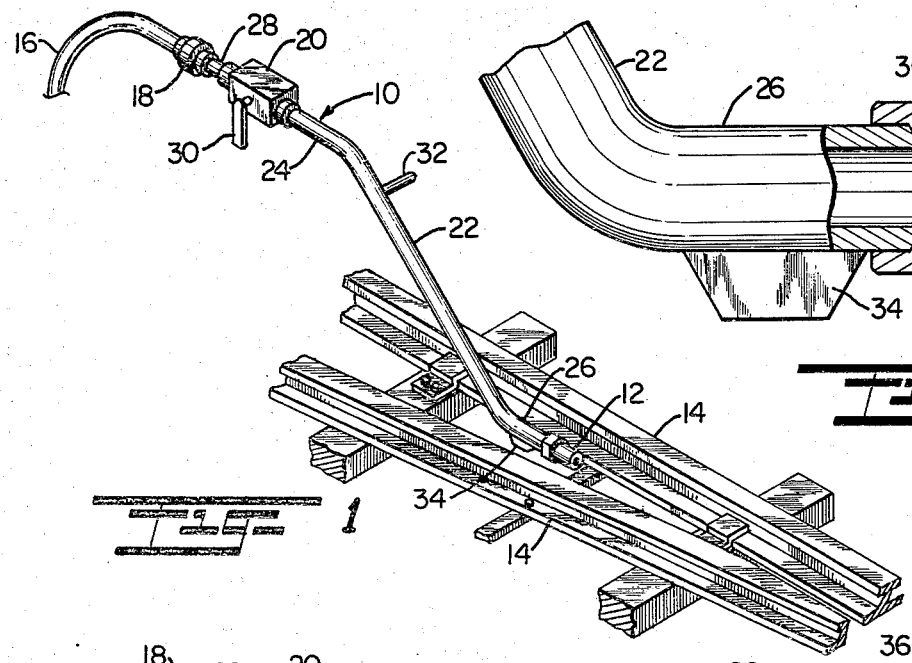
FIG. 1 is a perspective view of the pneumatic cleaning apparatus according to the preferred embodiment of the present invention.

The pneumatic railroad switch cleaning device according to the preferred embodiment of the present invention is shown in FIGS. 1–5 of this application. Broadly, the device includes an elongated body having one end connected by means of a valve to a pressurized air source while the other end terminates in a nozzle designed to be inserted in a narrow space such as a crevice or the channel between a pair of railroad rails representative of a typical railroad switch. As is shown in FIG. 1, pneumatic cleaning device 10 has nozzle 12 positioned between a pair of rails 14 as components of a standard railroad track switch, with cleaning device 10 being adapted for removing particulate material, such as debris or snow from the channel between the rails 14. The pneumatic railroad switch cleaning device 10 is connected to any conventional pressurized air source, such as the main air reservoir of a locomotive, by means of a flexible tube 16 and a coupling member 18. The opposite end of flexible tube 16 is preferably adapted for connection to the conventional "glad hand" coupling on a locomotive (not shown), so the switch cleaner device can be conveniently connected to the main air reservoir of a locomotive and used to clean snow from a switch mechanism anytime such conditions are encountered by a train crew. Most locomotives maintain air pressure in the main reservoir of about 140 p.s.i. and have sufficient air delivery capacity for operating the pneumatic railroad switch cleaner 10 satisfactorily to remove snow from switches. A valve 20 is provided to allow regulation of air flow from the pressurized air source through 16 by the operator of the device.

Figure 2:
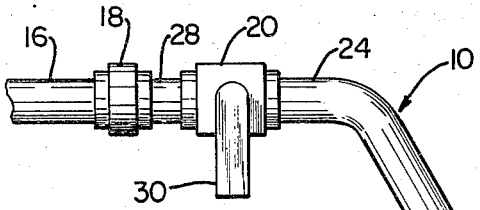
FIG. 2 is a side view in elevation of the pneumatic cleaning apparatus shown in FIG. 1.

FIG. 2 discloses a more detailed construction of cleaning device 10. Specifically, cleaning device 10 includes an elongated central body portion 22 which has a first end portion 24 and a second end portion 26 which has a first end portion 24 and a second end portion 22 such that end portion 24 and 26 have axes that are parallel with respect to one another. Preferably, end portions 24 and 26 each make a 45° angle with respect to the axis of body portion 22. This construction allows the operator to stand in an upright position when using cleaning device 10.

First end portion 24 is connected to valve 20 and valve 20 is connected to coupling member 18 by means of a hollow tube 28. These various connections are accomplished in any convenient manner, such as by threading one piece into another, but it is important to recognize that the connections allow pressurized air flow through flexible tube 16 to nozzle 12. To aid in controlling the flow of air, cleaning device 10 has a valve 20 including an on/off valve as is known in the art which is activated by means of a lever 30 to selectably allow or prevent the flow of air through cleaning device 10.

Figure 4:
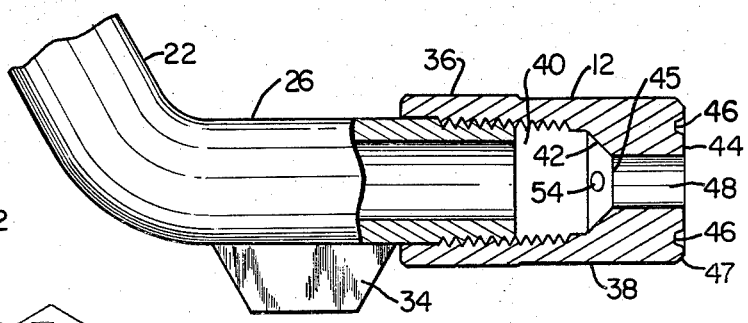
FIG. 4 is a side view of the nozzle end of the pneumatic cleaning apparatus taken in partial cross-section about lines 4—4 of FIG. 3.
Figure 5:
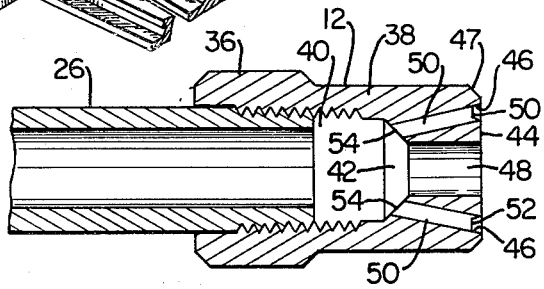
FIG. 5 is a cross-sectional view taken about lines 5–5 of FIG. 3.
Figure 3:
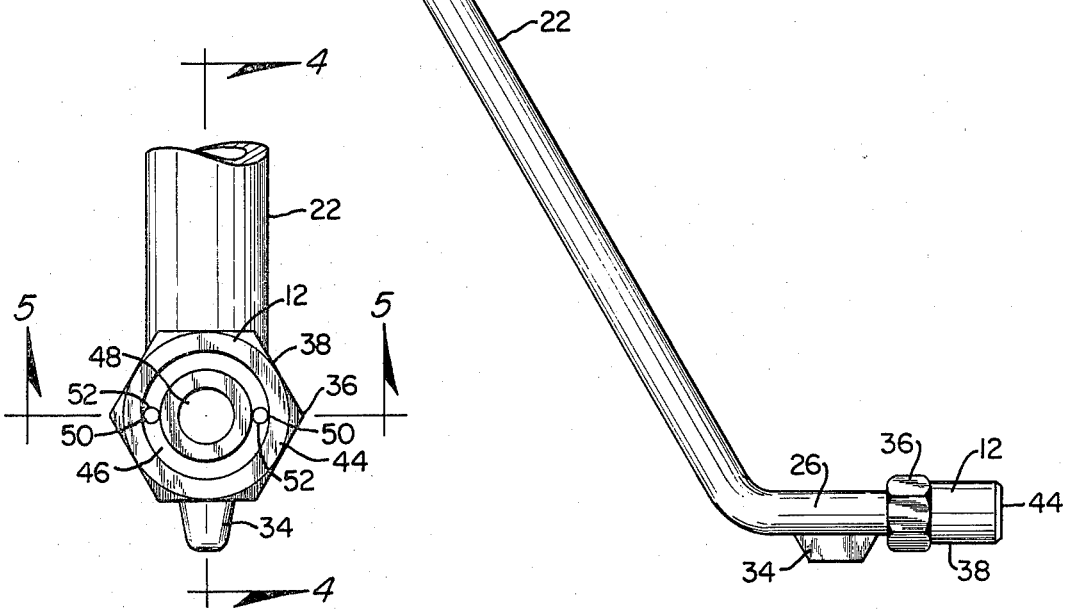
FIG. 3 is a front view in elevation of the nozzle end of the pneumatic cleaning apparatus.

Nozzle 12 is secured to the second end portion 26 of cleaning device 10 and is described in greater detail with respect to FIGS. 3–5. To facilitate grasping of cleaning device 10 by an operator, body portion 22 is provided with a laterally projecting handle 32 at an end thereof adjacent first end portion 24. Further, a spacer means defined by a runner 34 is attached to the side of end portion 26 so that it projects in a common plane with end portion 24 and 26. As is more clearly shown in FIGS. 3–5, nozzle 12 threadably receives end portion 26 so that it is securely mounted thereon. To this end, nozzle 12 is formed with a hexagonal head 36 and a cylindrical body portion 28, and is preferably constructed out of brass or other suitable material. Hexagonal head 36 is provided to permit mounting and removal of nozzle 12 on end portion 26. Nozzle 12 has an exterior end wall 44 which is formed transversely of the axis of second end portion 26. A cavity 40 is formed in the interior of nozzle 12 with this cavity 40 terminating in a frustoconical end wall 42 adjacent end wall 44. An annular channel or groove 46 is cut into the surface of endwall 44.

To allow a pressurized stream of air to be directed along a surface to be cleaned, a central jet port 48 is formed in nozzle 12 as an axial bore having an external mouth at end wall 44 and an internal mouth 45 adjoining a frustoconical end wall 42. A pair of smaller side jet ports 50 are formed in common plane with one another as bores which have external mouths 52 and internal mouths 54 with external mouths 50 formed in groove 46 and internal mouths 54 formed in frustoconical end wall 42. By cutting groove 46 in end wall 44, a rim 47 is defined on the circumferential edge of end wall 44. Since external mouths 50 open into groove 46, rim 47 protects mouths 50 from damage or deformation from striking objects during use of cleaning device 10 so that the device may be used in heavy duty applications. Jet ports 48 and 50 therefore define air outlet means to allow pressurized air entering pneumatic cleaning device 10 to exit along a predetermined path.

Side jet ports 50 are outwardly divergent with respect to one another and should be formed having an angle of divergence of less than 45°. Further, side jet ports 50 have an internal diameter approximately one fourth the internal diameter of central jet port 48. To allow this construction, groove 56 is formed concentrically of the external mouth of central jet port 48 with side jet ports 59 being disposed on diametrically opposite sides of the axis of central jet port 48 in a common horizontal plane. In the preferred form of the invention, side jet ports 50 diverge from one another at an angle of approximately 36°; this angle of divergence has been found to maximize the effectiveness of the pneumatic cleaning device 10 in lifting and removing particulate material from a surface to be cleaned.

Nozzle 12 is then mounted on second end portion 26 so that side jet ports 50 are oriented in a plane parallel to the surface to be cleaned and perpendicular to a plane defined by the axis of first and second end portions 24 and 26. Runner 34 is positioned in perpendicular relationship to the plane defined by side jet ports 50 to maintain nozzle 12 in spaced-apart relation from the surface to be cleaned.

In operation, second end portion 26 and nozzle 12 are inserted into a crevice to be cleaned, such as the channel formed by rails 14 in FIG. 1. Runner 34 rests on the surface to be cleaned and maintains nozzle 12 in spaced-apart relation thereto so that it does not become damaged by contact with that surface. By having end portions 26 and 24 formed at angles with respect to main body portion 22, nozzle 12 and end portion 26 are oriented horizontally of the surface to be cleaned with the plane of channel jet ports 50 also being oriented horizontally of the surface to be cleaned. This allows an operator to stand upright while using the pneumatic cleaning device 10, and the operator simply activates and de-activates the device by operating lever 30 to controllably allow or prevent passage of pressurized air through the device. Handle 32 is provided to facilitate grasping of cleaning device 10 by the user's hand.

Pressurized air, from this construction, exits nozzle 12 in a fan-shaped pattern such that a main stream of pressurized air is forwardly directed from central jet port 48 in a generally conic pattern. Side jet ports 50 discharge a less powerful, substantially planar, fan-shaped skirt of air laterally of central jet port 50. This skirt of air provides a lifting action to debris or snow which is in the crevice or channels to be cleaned and also prevents this debris or snow from being blown back into the crevice or channel as nozzle 12 is advanced forwardly along the surface to be cleaned by turning the snow laterally of the direction of the central port axis. This fan-shaped pattern, with the angles of divergence noted above, has been found to be critical for achieving a lifting force on the snow to lift it out of the space between the rails and prevent it from blowing or settling back into the space again. Many other constructions including constructions where a conical skirt of air is directed around a central nozzle, or where the side port has a greater angle of divergence from a central jet, have been found to merely blast at the snow allowing a significant portion thereof to reenter the channel to be cleaned, thus defeating the purpose of the jet cleaning apparatus. With this construction, it has been found that an operator can quickly and efficiently lift and remove snow up to two feet deep from between the rails of a railroad switch so that the rails will not become mechanically jammed by the snow or other debris therebetween.

Although the present invention has been described with particularity relative to the foregoing detailed description of the preferred embodiment, various modifications, changes, additions and applications other than those specifically mentioned herein will be readily apparent to those having normal skill in the art without departing from the spirit and scope of this invention.

What is claimed is:

1. A pneumatic cleaning device adapted to be connected to a pressurized air source for cleaning crevices and the like, comprising:

an elongated hollow body member having a first end adapted to be connected to said air source in fluid communication therewith; and a nozzle secured to a second end of said hollow body member in fluid communication therewith, said nozzle including jet means for discharging a stream of pressurized air, said jet means including a forwardly directed central port and a pair of forwardly directed side ports, said central port and said side ports having axes oriented in a common plane with one of said said ports being on each side of said central port and being outwardly divergent from the axis of said central port, said side ports operative to lift particulate material from the surface to be cleaned and turning said material laterally of the direction corresponding to the axis of said central port.

2. A pneumatic cleaning device according to claim 1 including valve means associated with said body member for controlling the flow of air from said air source through said body member.

3. A pneumatic cleaning device according to claim 1 including a handle member attached to said body member to facilitate gripping of the cleaning device by an operator thereof.

4. A pneumatic cleaning device according to claim 1 wherein said side ports are outwardly divergent from one other at an angle less than 45 degrees.

5. A pneumatic cleaning device according to claim 4 wherein said central port and said side ports are cylindrical, said central port having a diameter four times greater than the diameter of each said side port.

6. A pneumatic cleaning device according to claim 4 wherein said nozzle has a forward face formed transversely of its longitudinal axis, said forward face having a groove formed therein concentrically of said central port, said side ports having exterior mouths opening into said groove, and said central port being larger than each of said side ports.

7. A pneumatic cleaning device according to claim 4 wherein said body member has a first end section at said first end, a mid-section and a second end section at said second end, said second end section oriented at an obtuse angle with respect to said mid section, said nozzle and said second end section having a common axis, said side ports being symmetrically disposed about said common axis in a plane perpendicular to the plane defined by said mid-section and said second end section.

8. A pneumatic cleaning device according to claim 7 wherein said first end section is oriented in a direction parallel to said second end section.

9. A pneumatic cleaning device according to claim 7 including spacer means on one of said nozzle and said second end section for maintaining said nozzle in spaced apart relation from a surface to be cleaned.

10. A pneumatic cleaning device according to claim 5 wherein said spacer means includes a runner member projecting in a direction perpendicular to the plane of said side ports.

11. A pneumatic cleaning device connectable to a pressurized source of air and adapted for cleaning particulate material from crevices and the like, comprising:

a hollow body member having an elongated mid-section, a first end section and a second end section opposite said first end section, each of said end sections oriented at an obtuse angle to said mid-section whereby the axes of said first and second end sections are substantially parallel;

valve means connected to said first end section and connectable to said source of air for controlling the flow of air though said body portion;

a nozzle connected to said second end section, said nozzle having a central jet port and a pair of side jet ports forwardly directed and having axes oriented generally in a common plane for discharging streams of air therefrom, said side jet ports being outwardly divergent from one another at an angle of less than 45° whereby air is discharged in a fan-shaped pattern, said side ports operative to lift particulate material from the surface to be cleaned; and spacer means secured to said body member for maintaining said nozzle in spaced-apart relation from a surface to be cleaned, said spacer means and said jet ports positioned whereby the fan shaped pattern of air is discharged along the surface to be cleaned when said spacer means rests thereon.

12. A pneumatic cleaning device according to claim 11 wherein said side jet ports diverge from one another at an angle of approximately 36°.

13. A pneumatic cleaning device according to claim 11 wherein said spacer means includes a runner member positioned on said second end section and projecting therefrom in a direction perpendicular to the plane of said side jet ports.

14. A pneumatic cleaning device according to claim 11 wherein said first and second end sections are each oriented at an angle of approximately 135° to said mid-section, the plane of said side jet ports being perpendicular to the plane defined by said first and second end sections.

* * * * *